US005630546A

United States Patent [19]

Velch

[11] Patent Number: 5,630,546

[45] Date of Patent: May 20, 1997

[54] BROCHURE HOLDER AND POINT OF SALE DISPLAY SYSTEM

[75] Inventor: William A. Velch, Long Lake, Minn.

[73] Assignee: Bailey Nurseries, Inc., St. Paul, Minn.

[21] Appl. No.: 252,934

[22] Filed: Jun. 2, 1994

[51] Int. Cl.[6] ..... B65D 43/16

[52] U.S. Cl. ..... 229/125.37; 206/425; 206/449; 229/141; 248/205.3

[58] Field of Search ..... 206/44, 45, 34, 206/215, 425, 449, 450, 555; 229/125.37, 125.38, 141, 148–153, 154, 162; 248/205.3, 311.2

[56] References Cited

U.S. PATENT DOCUMENTS

| | | | |
|---|---|---|---|
| 134,051 | 12/1872 | Groat . | |
| 149,889 | 4/1874 | Smith . | |
| 1,674,005 | 6/1928 | Eschenbach . | |
| 1,983,499 | 12/1934 | Rosenthal | 206/45.34 |
| 2,233,207 | 2/1941 | Gillam | 206/45.34 |
| 2,353,298 | 7/1944 | Dorfman . | |
| 2,701,677 | 2/1955 | Grammer | 229/125.38 |
| 2,755,576 | 7/1956 | Golden | 248/205.3 |
| 2,942,770 | 6/1960 | Eichorn | 206/449 |
| 3,378,186 | 4/1968 | Thompson | 206/45.34 |
| 3,881,649 | 5/1975 | Krautsack | 229/152 |
| 3,966,113 | 6/1976 | Tipton | 229/149 |
| 4,133,123 | 1/1979 | Anderson . | |
| 4,534,125 | 8/1985 | Buck . | |
| 4,972,616 | 11/1990 | Doll . | |
| 5,044,200 | 9/1991 | Dailey et al. . | |
| 5,117,972 | 6/1992 | Herrin et al. . | |
| 5,301,800 | 4/1994 | Kenney | 211/50 |

FOREIGN PATENT DOCUMENTS

| | | | |
|---|---|---|---|
| 2327163 | 5/1977 | France | 206/449 |
| 2674503 | 10/1992 | France | 229/125.37 |
| 286293 | 11/1990 | Japan | 206/425 |
| 717950 | 11/1954 | United Kingdom | 229/152 |
| 913107 | 12/1962 | United Kingdom | 248/205.3 |

OTHER PUBLICATIONS

Braeside LAW–4 Outdoor Literature Holder, catalog page dated Jun. 1991.

*Primary Examiner*—Jimmy G. Foster
*Attorney, Agent, or Firm*—James W. Miller

[57] ABSTRACT

A point of sale display system comprises a printed poster having a novel brochure holder attached to one face thereof. The poster is itself supported in a vertically upright condition by a rigid backing member and a stake or post. The brochure holder is provided in an unassembled form using a single piece of plastic material that is cut and scored to be capable of being bent and assembled into a three-dimensional assembled form. When so assembled, the brochure holder comprises a lightweight, upright body having an upwardly facing brochure holding cavity. The body is closed by a pivotal top cover that may be releasably secured to the body by a hook and pile fastening system.

8 Claims, 2 Drawing Sheets

BROCHURE HOLDER AND POINT OF SALE DISPLAY SYSTEM

TECHNICAL FIELD

This invention relates to a simple, inexpensive brochure holder that can be easily adhered to any vertical surface and is self supporting thereon to hold and store a supply of brochures or other written information. In addition, this invention relates to a cost effective point of sale display system for use in an outdoor environment exposed to the weather which system includes the brochure holder. The system includes a display poster supported in an upright orientation relative to the ground with the aforementioned brochure holder being mounted on the poster.

BACKGROUND OF THE INVENTION

Many businesses often operate, at least partially, in an outdoor sales environment. For example, a plant nursery sells live plants that are often kept outside, either potted plants or plants still in the ground. In such an outdoor environment, the plants are necessarily exposed to the weather. The plants are also often grouped together with plants of the same type being placed adjacent one another. For example, the birch trees will be in one group, the spruce trees in another group, and so on over the grounds of the nursery.

Plant nurseries are not the only business in which the inventory is held and displayed for sale outdoors. Other businesses also often store all or part of their goods outdoors in related groups. For example, stones, paving blocks, aggregate materials and the like used for paving or landscaping are often segregated together in related groups and stored outdoors. Farm implement dealers, sellers of patio furniture, and similar businesses often keep at least a portion of their inventory outdoors.

In these outdoor sales environments, customers often browse or stroll around the grounds to inspect the inventory of goods while attempting to select what they wish to purchase. It is well known that sales can be increased by providing relevant sales information to such customers at the point of sale. Thus, if a customer is inspecting various types of trees in a plant nursery in an attempt to purchase a suitable tree for an intended use, or various types of stones in an attempt to purchase the right stone for a landscaping use, the chances of making a sale are increased if relevant written information could be easily provided to the customer at that time and at that location.

However, until this invention, such written information would normally be available, if at all, back inside the permanent buildings of the business because of the need to protect such information from the weather. Thus, the customer has to first go back inside to collect such information and then may have to go back outside to continue viewing the goods while reading the information. Some sales are undoubtedly lost due to the inconvenience in doing this. In addition, space inside the building which is available for the display of written information is at a premium compared to the space that is available outdoors, thus discouraging the use and availability of written information inside the building.

Permanent enclosures in the nature of cabinets could be erected for holding and storing such written information outdoors on the grounds of the business. However, the location of the various types of goods being sold is apt to change over the course of the selling season or from one selling season to the next, and the selling area may be extensive requiring a large number of such enclosures. In addition, such permanent enclosures are expensive to construct and maintain. Accordingly, such permanent enclosures are generally impractical for these types of businesses due to their expense and the difficulty involved in relocating them.

More recently, the real estate industry has attempted to provide point of sale information about a house or property at the location of the For Sale sign. In doing so, various kinds of mailbox type holders have been used to store informational sheets or brochures describing the property offered for sale. Some of these holders have an attached stake to allow them to be self supporting by driving the stake into the ground, and some holders use a bracket to allow them to be screwed or mounted onto the top edge of the For Sale sign. However, like permanent enclosures, such mailbox type holders are constructed of rigid, heavy material and are quite expensive to ship and purchase.

SUMMARY OF THIS INVENTION

Another aspect of this invention relates to the brochure holder per se. Such a brochure holder is one which is provided in an unassembled form from a single piece of plastic material that may be laid flat in a relatively planar two-dimensional configuration. The brochure holder is capable of being assembled into a three-dimensional assembled form by bending various portions thereof relative to one another and securing some of the bent portions together. The brochure holder in its assembled form comprises a body having an upwardly facing cavity and a top cover pivotally joined to the body by a fold line to close off the cavity. A means is carried on the body and the cover for releasably securing the cover to the body to keep the cover closed thereon.

Another aspect of this invention is to provide a point of sale display system that is inexpensive to purchase and easy to use by businesses having an outdoor sales environment. Such a system is provided by a printed display poster which generally pictures at least some of the goods being sold and provides a message to the customer regarding the goods. The poster is printed onto a flexible material that is impervious to weather, e.g. styrene, and is adapted for being supported in a vertical orientation by being applied to a backing member that is supported on the ground in an upright fashion. The system includes a brochure holder made of a lightweight, flexible plastic material. The brochure holder comprises an upright body having an upwardly facing brochure holding cavity and a pivotal top cover secured to the body and adapted to be pivoted downwardly to cover and close the cavity. The body and cover of the brochure holder are configured to provide a completely enclosed brochure holding cavity when the top cover is closed to protect any brochures held therein from the weather. The cavity is sized to retain therein a supply of brochures which contain printed information relating to the goods being sold. The overall weight of the brochure holder when filled with a supply of brochures is sufficiently small so that the brochure holder can be supported on a front face of the poster.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
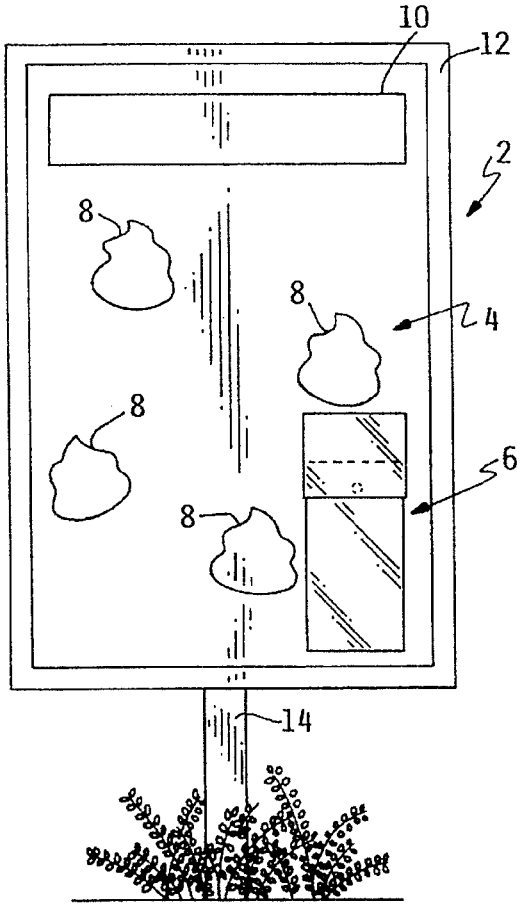
FIG. 1 is a side elevational view of various components of this invention, particularly illustrating a display poster attached to a self supporting backing member and a brochure holder adhered to the display poster.

Referring first to FIG. 1, one point of sale display system according to this invention, generally illustrated as 2, is well suited for businesses which operate, at least partially, in an outdoor sales environment. System 2 has two primary components that are preferably packaged together in kit form: a) a point of sale display poster 4; and b) a novel, inexpensive brochure holder 6 for use on poster 4. Both of these components are inexpensive to manufacture and ship and, thus, inexpensive to purchase. Consequently, they are easily affordable in the large numbers often required by businesses, such as plant nurseries, which need relatively large numbers of posters and display holders spread throughout a large outdoor sales area.

Poster 4 comprises a sheet of flexible, weather proof material, preferably made from styrene or a similar material, which is printed to display or describe in a general manner the goods being sold by the business. For example, when system 2 is used for selling live plants at a plant nursery, poster 4 would include various pictures 8 of plants generally, or pictures 8 of some of the plants being sold throughout the entire nursery, or even just pictures 8 of the plants being sold in the immediately surrounding area. Poster 4 also preferably includes a box 10 for carrying a title of some type relating to plants or gardening, or for displaying other desired information. For example, it is preferable that box 10 or some other area of poster 4 send a message to the customer describing some benefit associated with the goods being sold. Again, if plants or seeds for growing fruits or vegetables are being sold in the area of poster 4, poster 4 could be used to send a message of health, freshness when growing your own fruits or vegetables, the wholesomeness of prepared food products using fruits or vegetables, etc.

Poster 4 is of suitable size to be easily seen. While the size and shape of poster 4 can vary, poster 4 can be generally rectangular in shape, as shown in FIG. 1, and may be approximately 15" by 22".

Poster 4 by itself is not self-supporting as it is made of a flexible, weatherproof materialin sheet form. Thus, poster 4 is mounted on a rigid backing member 12 made of wood or any other suitably rigid material that is sized to be the same size as, or slightly larger than, poster 4. Poster 4 is mounted to a front side of backing member 12 by being screwed, nailed or stapled thereto.

A vertical post or stake 14 is provided to support backing member 12, and thus poster 4 attached thereto, in an upright orientation. Stake 14 has its upper end nailed or otherwise secured to the back side of backing member 12. The lower end of stake 14 could be sharpened to be capable of being driven into the ground as shown in FIG. 1, or the lower end of stake 14 could be cemented into a bucket or other container that would simply rest on the ground. The cement bucket method is preferred in most cases because poster 4 can be moved around the outdoor sales area simply by moving the bucket, and yet the cement bucket is heavy enough to keep poster 4 in place. In any event, the combination of backing member 12 and stake 14 provides necessary support to poster 4 and maintains poster 4 in a vertically upright orientation.

While backing member 12 and stake 14 could be provided as part of a kit for selling display system 2, they would be relatively heavy and thus costly to ship. In addition, most retail environments of the type to which this display system 2 is best suited, e.g. garden stores, nurseries, retailers of stone or aggregate materials, lumber yards, used or new car lots, farm and turf equipment dealers, etc., are well equipped to cut any number of backing members and stakes from raw lumber materials. Accordingly, it is anticipated that each kit for display system 2 will include only a poster 4 and a brochure holder 6, with any needed backing members 12 and stakes 14 being provided by the purchaser of such kits.

An important part of the point of sale display system 2 is a unique brochure holder 6 that is sold as part of system 2. As shown in FIG. 1, brochure holder 6 is designed to be affixed to the vertical front face of poster 4.

Brochure holder 6 is preferably made from a clear, transparent plastic and will be provided in a knocked down, unassembled form so that it can be shipped flat. This allows a substantial savings in shipping and handling. Thus, display system 2 will preferably be sold in kit form comprising at least one poster 4 and at least one brochure holder 6 which can be easily and inexpensively shipped in a lightweight, flat package that is sized to be slightly larger than poster 4. Multiple kits for display system 2 could also be shipped in a single package by enclosing therein a number of posters 4 and a corresponding number of brochure holders 6. For example, if a package were shipped with ten posters 4, then the same package would also include ten brochure holders 6.

Figure 2:
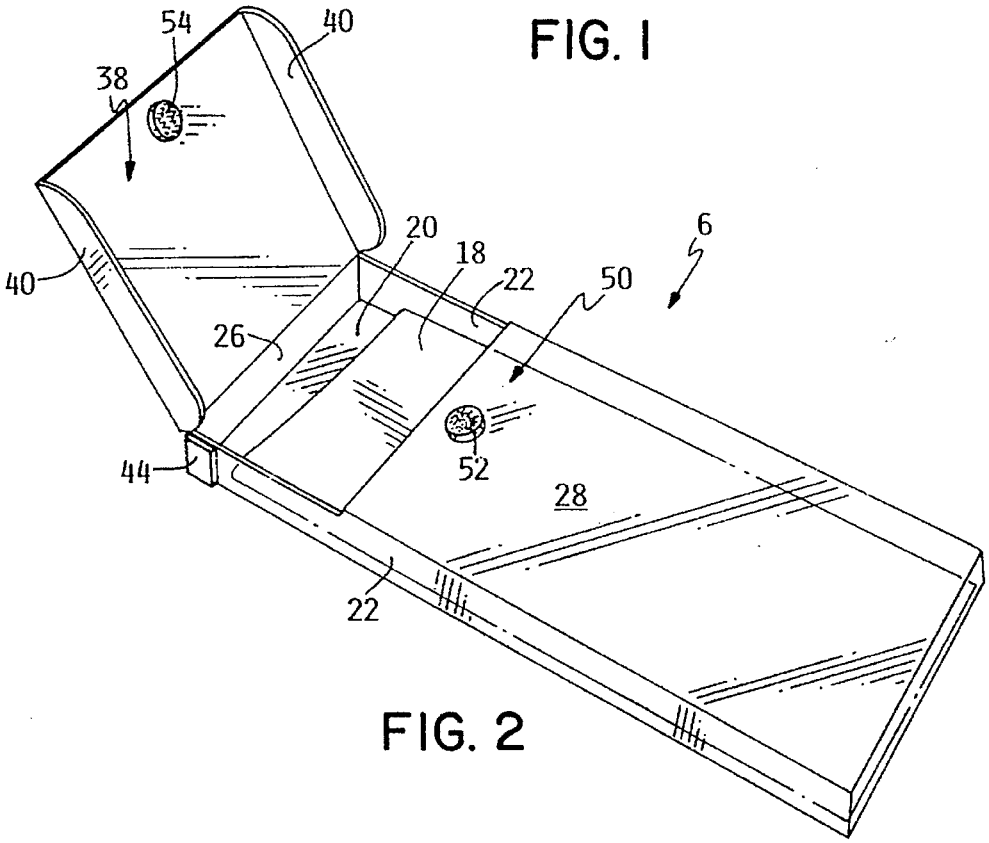
FIG. 2 is a perspective view of the brochure holder of this invention, particularly illustrating the top cover or flap of the brochure holder being pivoted to an open position with at least one brochure being contained inside the brochure holder.

Brochure holder 6 of this invention is very inexpensive to produce and sell, and yet does a very good job of protecting a supply of printed brochures from the weather. Holder 6 is made from a single sheet of lightweight plastic material that is relatively thin and flexible, e.g. from a clear vinyl plastic material having a thickness of approximately 10 mils. This sheet of plastic material is cut and scored so that brochure holder can be shipped in the knocked down, unassembled, two-dimensional form shown in FIG. 4, but it can be easily bent and assembled into the assembled, three-dimensional form shown in FIG. 2.

Figure 3:
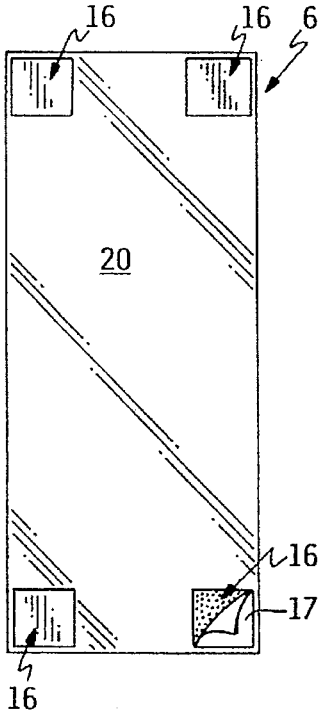
FIG. 3 is a rear elevational of the brochure holder of this invention, particularly illustrating the adhesive patches for adhering the brochure holder to the display poster.

Once assembled, brochure holder 6 is so lightweight that four small pieces of pressure sensitive tape or adhesive patches 16 on the four corners of the rear face of back wall can be used to adhere it to the face of poster 4. FIG. 3 shows these adhesive patches 16. Such adhesive patches are covered by backing strips 17 which must be peeled away to uncover the adhesive material and allow brochure holder 6 to be pressed up against poster 4. FIG. 1 illustrates a brochure holder 6 having been affixed in this manner to the lower right corner of a poster 4. Once so attached, a supply of rectangularly shaped, printed brochures 18 will be placed into brochure holder 6 and stored therein for reference or removal by a customer.

Brochures 18 stored in brochure holder 6 are intended to carry written information relating to the goods being sold in the outdoor sales environment of the business under consideration. For example, when live plants are being sold by a garden store or nursery, the brochure might explain what the various plants are, what their uses and characteristics are, how they should be planted and pruned, etc. This information could be generalized to apply to the entire range of plants being sold in the entire garden store or nursery, or could be more specific to the plants being sold in that immediate area. If the goods being sold relate to other things such as various types of landscape stones, then the information on the brochures would relate to the characteristics of the stones, their relative uses, etc.

Figure 4:
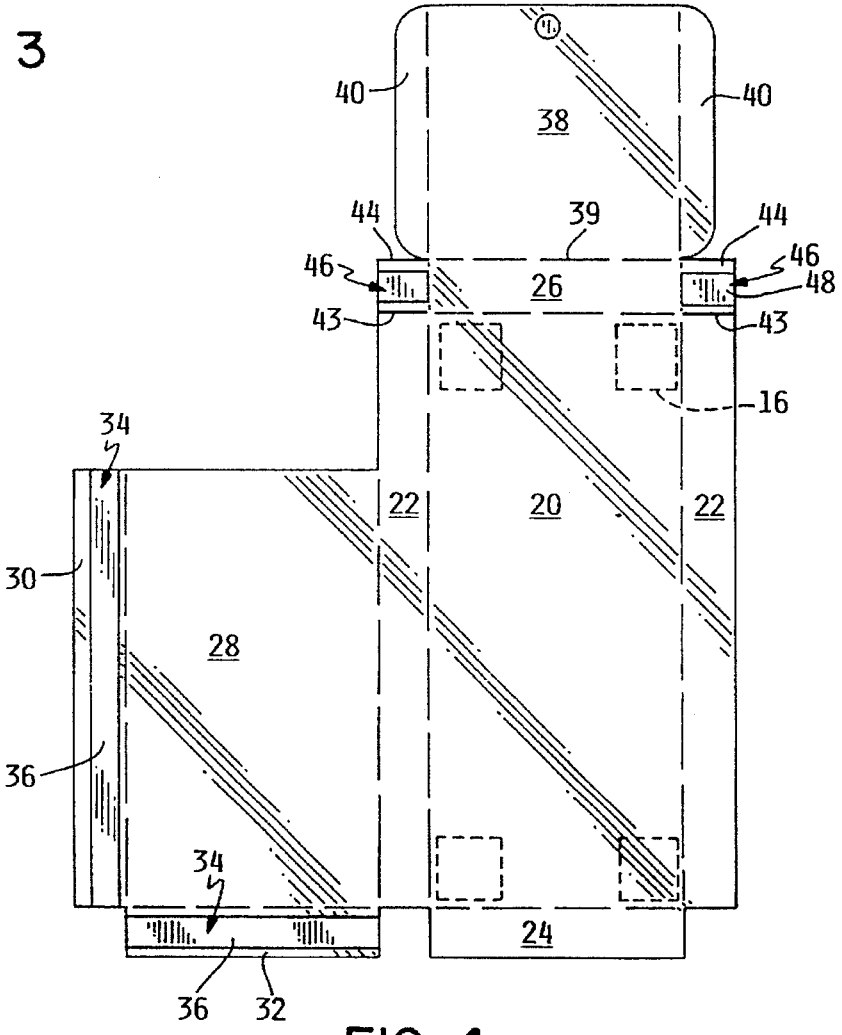
FIG. 4 is a top plan view of the blank that is used to form the brochure holder shown in FIGS. 2 and 3, the blank being shown in its flat, knocked down, unassembled form.

Brochure holder 6 is easy to assemble, but when assembled forms a completely enclosed compartment for protecting brochures 18. Referring now to FIG. 4, the blank for forming holder 6 includes a large rectangular back wall 20 having scored side walls 22, a scored bottom wall 24 and a scored top wall 26. In addition, the blank includes a smaller rectangular front wall 28 that extends to one side from one of the side walls 22 with front wall 28 having a scored side attachment panel 30 and a scored bottom attachment panel 32. The side and bottom attachment panels 30 and 32 have adhesive strips 34 provided thereon which are normally protected by backing strips 36. In addition, the front edge of the top wall 26 includes a top flap or cover 38 that is connected thereto along a fold line 39 to allow cover 38 to pivot relative to the rest of holder 6. Cover 38 includes scored side panels 40.

To assemble brochure holder 6, the blank is laid flat as shown in FIG. 4. The blank can then be folded along the score lines such that side walls 22, bottom wall 24 and top wall 26 are bent upwardly approximately 90° to extend upwardly relative to back wall 20 which remains flat. Front wall 28 is then bent 90° relative to side wall 22 to which it is attached to allow front wall 28 to extend horizontally across and be parallel to but spaced above back wall 20. Attachment panels 30 and 32 on front wall 28 are then bent downwardly 90° to point back towards back wall 22. The backing strips 36 are then removed to expose adhesive strips 34, side attachment panel 30 is overlapped with right side wall 22, bottom attachment panel 32 is overlapped with bottom wall 24, and the panels 30 and 32 are pressed inwardly to adhesively secure themselves to walls 22 and 24 to form the enclosed body portion of brochure holder 6.

Two small attachment flaps 44 are provided at each end of top wall 26 with such flaps 44 having a cut line 43 separating each flap 44 from side wall 22. Each flap 44 has a small adhesive patch 46 protected by a backing strip 48. The backing strips 48 are now removed to expose adhesive patches 46, and flaps 44 are now bent downwardly 90° relative to top wall 26 over the top ends of each side wall so that one flap 44 is secured to the top of each side wall 22. See FIG. 2. Flaps 44 prevent any rain or the like from entering brochure holder 6 by covering any gaps or openings at the junctions between side walls 22 and top wall 26. The side panels 40 on top cover 38 are now bent 90° relative to top cover 38 to form a generally U-shaped cover, and top cover 38 is now further bent along its score line 39 until it closes down over front wall 28 of brochure holder 6. Side panels 40 on top cover 38 will overlap the outside of the upper portion of side walls 22 to further prevent the entry of moisture into the interior of holder 4.

Preferably, a means 50 is provided for keeping cover 38 closed on brochure holder 6. This closing means 50 preferably comprises a Velcro® hook and pile fastener where one portion 52 of the fastener is placed on front wall 28 and another portion 54 of the fastener is placed on the inside of top cover 38 adjacent its lower edge. These fastener portions 52 and 54 are aligned with one another when top cover 38 is pivoted to its closed position. When top cover 38 is pressed against front wall 28 of brochure holder 6, the fastener portions 52 and 54 are adhered to one another to keep top cover 38 closed on the body portion of brochure holder 6.

Thus, when assembled, brochure holder 6 has a shape similar to a vertically upright, rectangular mailbox, but is made of a very lightweight plastic material. For example, when using a plastic vinyl material of approximately 10 mils, a brochure holder approximately 10 inches long, 4 inches wide, and 0.75 inches deep, will weigh approximately one ounce. Such a brochure holder will be able to store up to approximately 20 to 40 brochures 18 that are printed on standard size 8.5×11 paper and which are folded in thirds to be sized slightly smaller than brochure holder 6. The weight of the brochures will be many times that of brochure holder 6 alone, e.g. 3 to 6 ounces worth of brochures versus only one ounce for brochure holder 6. Nonetheless, brochure holder 6 can be easily supported on a vertical surface, including on the face of poster 4, by four small adhesive patches 16 on the back of rear wall 20 with the patches sized approximately 1 inch by 1 inch. This is true even when brochure holder 6 carries the aforementioned supply of printed brochures 18 therein.

In addition, when brochure holder 6 is assembled and in place on poster 4, and when top cover 38 is closed against front wall 28, brochure holder 6 forms a completely enclosed compartment that protects brochures 18 from the weather, including from wind and rain. Moreover, wind gusts will not cause top cover 38 to fly open due to the positive engagement provided by fastening means 50. Because brochure holder is so lightweight, it can be easily secured to a vertical surface using adhesive patches 16 without having to drill, screw or bolt holder 6 in place. Thus, brochure holder 6 is easy to install and is itself impervious to the effects of wind and rain and adequately protects the supply of brochures 18 held therein.

Brochure holder 6 can be formed out of any suitable weatherproof plastic material as previously noted. This plastic material could be colored if so desired, but preferably is sufficiently transparent to allow the supply of brochures 18 to be seen by looking through the transparent walls of holder 6. Thus, brochures 18 contained in brochure holder 6 will be visible to the customer who can tell at a glance whether holder 6 has such brochures or is empty.

This invention provides a very cost effective display system for point of sale displays in an outdoor sales environments. Each brochure holder can be sold for approximately a cost of $3.00. This is significantly less than other known brochure holders. In addition, brochure holder 6 forms a completely enclosed holder which will protect brochures even in foul weather conditions.

In using system 2, the business will purchase any number of kits comprising a desired number of posters and a corresponding number of brochure holders. Posters 4 will be attached to backing members 12 and one brochure holder 6 will be secured to each poster. The assembled posters 4 and brochure holders 6 can then be spread around the outdoor sales environment at strategic spots so that a supply of brochures 18 is always available to the customer at the point of sale. The location of posters 4 can be easily changed either by uprooting stakes 14 and moving to a new location or by simply picking up and moving any cement buckets in which stakes 14 are mounted.

Various modifications of this invention will be apparent to those skilled in the art. For example, while brochure holder 6 can be sold as part of a kit that also includes a poster 4, brochure holder 6 could be sold separately by itself. In this case, brochure holder 6 could still be affixed using adhesive patches 16 to any smooth vertical surface that might be present at the site, e.g. to a permanent sign or the side of a building or other structure. Accordingly, this invention is to be limited only by the appended claims.

I claim:

1. A brochure holder, which comprises:

(a) a rear wall having integral side walls, a top wall, and a bottom wall connected thereto by fold lines such that the side, top and bottom walls are bendable relative to the rear wall along the fold lines, the side, top and bottom walls capable of being bent at 90° relative to the rear wall to form a three dimensional pocket bounded thereby;

(b) a front wall extending from one of the side walls and connected to the one side wall along a fold line such that the front wall is bendable relative to the one side wall, the front wall capable of being bent at 90° relative to the one side wall to extend across the width of the rear wall and be spaced from but parallel to the rear wall to enclose a front side of the pocket, the front wall being shorter than the rear wall;

(c) means for securing the front and rear walls together to form an assembled pocket comprising a side attachment panel and a bottom attachment panel carried on the front wall which are suited for being bent at 90° relative to the front wall along fold lines, wherein the attachment panels carry adhesive strips to allow such attachment panels to be pressed against and secured to the other side wall and the bottom wall;

(d) the top wall having outwardly extending flaps secured at each side thereto by fold lines with such flaps being separated from the rear wall by cut lines such that the flaps are bendable relative to the top wall, the flaps being capable of being bent down over and secured to the upper ends of each side wall to close any gaps between the side walls and the top wall to prevent the transmission of moisture therebetween; and (e) a pivotal cover secured to a front edge of the top wall by a fold line, the cover having means for releasably securing the cover to the front wall when the cover is pivoted downwardly to close the cover over the pocket.

2. The brochure holder of claim 1, wherein the brochure holder is made of a flexible vinyl plastic material having a thickness of approximately 10 mils.

3. The brochure holder of claim 1, wherein the plastic material forming the brochure holder is transparent to allow a supply of brochures contained inside the brochure holder to be seen.

4. The brochure holder of claim 3, wherein the plastic material forming the brochure holder is clear.

5. The brochure holder of claim 1, further including a plurality of spaced adhesive patches on a back wall of the brochure holder for attaching the brochure holder to a vertical supporting surface.

6. The brochure holder of claim 1, wherein the brochure holder is rectangularly shaped with a long dimension thereof extending vertically.

7. The brochure holder of claim 1, wherein the cover has rearwardly extending side flaps bent at 90° relative to the cover to overlie the side walls of the brochure holder when the cover is closed.

8. The brochure holder of claim 7, wherein the cover securing means comprises a hook and pile fastening system.

* * * * *